US008763172B1

(12) United States Patent
Edwards

(10) Patent No.: US 8,763,172 B1
(45) Date of Patent: Jul. 1, 2014

(54) CONCEALING SYSTEM FOR HIDING UNSIGHTLY HOOKS AND RODS IN BATHROOMS

(76) Inventor: Virginia A. Edwards, Boynton Beach, FL (US)

( * ) Notice: Subject to any disclaimer, the term of this patent is extended or adjusted under 35 U.S.C. 154(b) by 0 days.

(21) Appl. No.: 13/534,472

(22) Filed: Jun. 27, 2012

(51) Int. Cl.
*A47K 3/34* (2006.01)
*A47K 3/38* (2006.01)

(52) U.S. Cl.
CPC ..... *A47K 3/38* (2013.01)
USPC ..... 4/607; 4/605; 4/609

(58) Field of Classification Search
CPC ..... A47K 3/38
USPC ..... 4/557–559, 605, 607–609; 160/89, 327
See application file for complete search history.

(56) References Cited

U.S. PATENT DOCUMENTS

| | | | | | |
|---|---|---|---|---|---|
| 1,980,618 | A | * | 11/1934 | Gaines | 160/89 |
| 3,083,494 | A | | 4/1963 | Lindenbaum | |
| 5,070,550 | A | * | 12/1991 | Reeves | 4/608 |
| 5,101,877 | A | | 4/1992 | Subecz et al. | |
| 5,154,218 | A | | 10/1992 | Subecz | |
| 5,384,921 | A | * | 1/1995 | Zieg | 4/609 |
| D362,147 | S | | 9/1995 | Voccia | |
| 5,732,420 | A | * | 3/1998 | Micciche | 4/559 |
| 7,909,082 | B2 | | 3/2011 | Peoples | |
| 2006/0248641 | A1 | | 11/2006 | Kinstle et al. | |

* cited by examiner

*Primary Examiner* — Tuan N Nguyen

(57) ABSTRACT

A concealing system for hiding shower curtain rods in bathtubs and shower compartments featuring a pair of extension rods oriented parallel to each other and spaced a distance apart and a sheet spanning between the pair of extension rods. The extension rods are sandwiched between the shower compartment walls and positioned to cover and conceal the shower curtain rod.

1 Claim, 3 Drawing Sheets

(In-use View)

(ISO View)

(Front View)

(Back View)

(End View)

(In-use View)

CONCEALING SYSTEM FOR HIDING UNSIGHTLY HOOKS AND RODS IN BATHROOMS

BACKGROUND OF THE INVENTION

In most bathrooms, the hooks and rods of shower curtains are visible. Many of these hooks and rods are unsightly. The present invention features a concealing system for shower curtain rods to help hide the unsightly hooks and rods in the bathroom. The system of the present invention can also help improves the aesthetic appearance of bathrooms.

Any feature or combination of features described herein are included within the scope of the present invention provided that the features included in any such combination are not mutually inconsistent as will be apparent from the context, this specification, and the knowledge of one of ordinary skill in the art. Additional advantages and aspects of the present invention are apparent in the following detailed description and claims.

DESCRIPTION OF PREFERRED EMBODIMENTS

Referring now to FIG. 1-5, the present invention features a concealing system (100) for shower curtain rods to help hide the unsightly hooks and rods in the bathroom. The system of the present invention can also help improves the aesthetic appearance of bathrooms. The present invention also features a bathroom system (200) comprising a shower (or bathtub compartment) and the concealing system (100).

Figure 1:
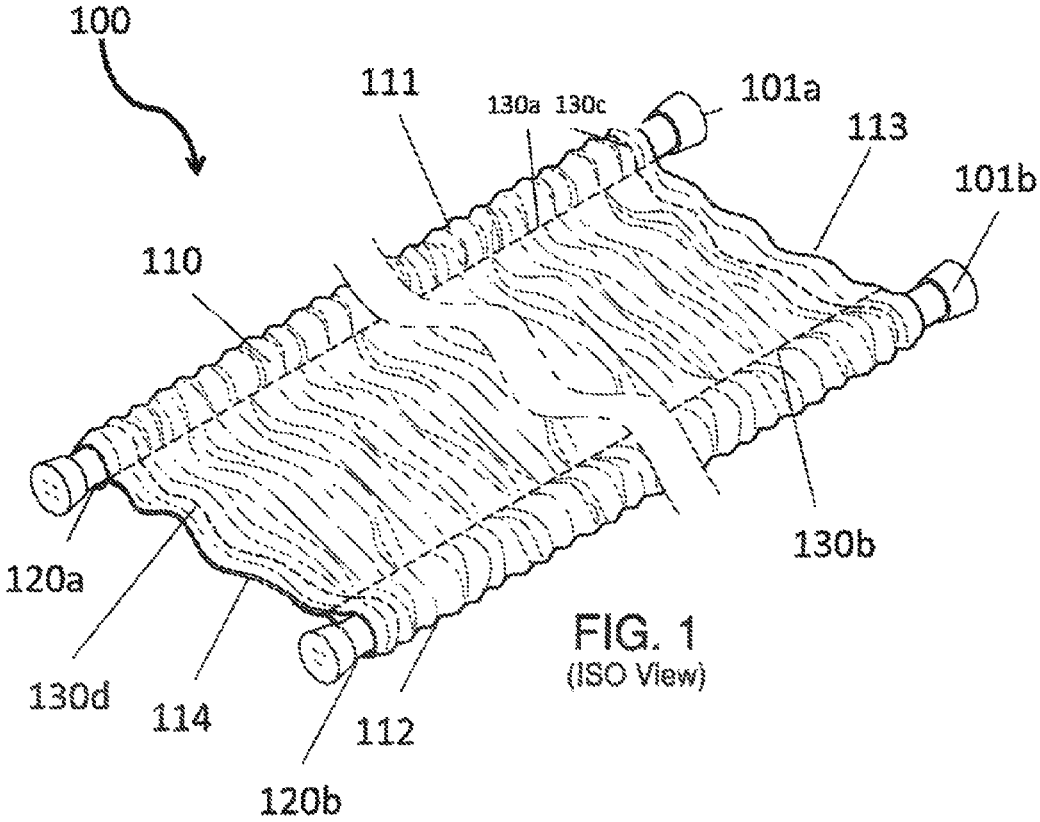
FIG. 1 is a perspective view of the system of the present invention.
Figure 2:
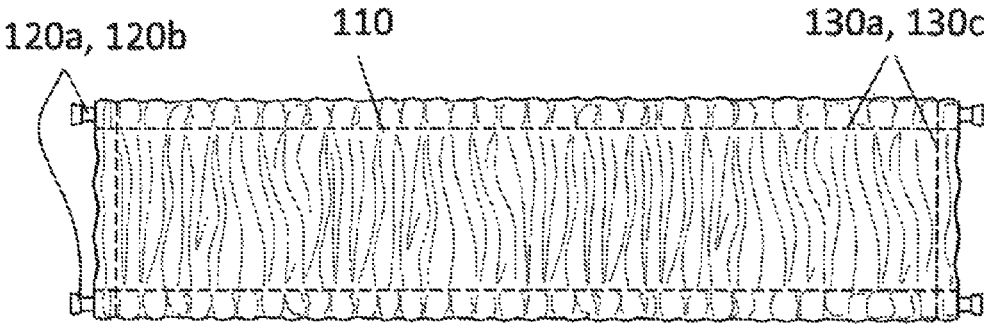
FIG. 2 is a front view of the system of the present invention.
Figure 3:
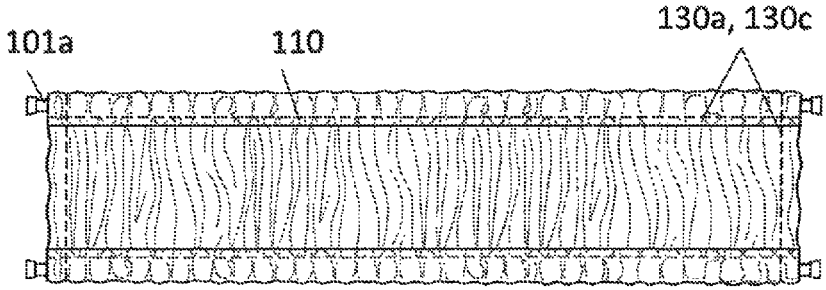
FIG. 3 is a back view of the system of the present invention.
Figure 4:
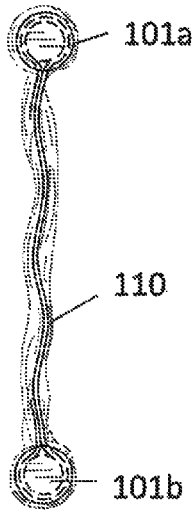
FIG. 4 is a side view of the system of the present invention.
Figure 5:
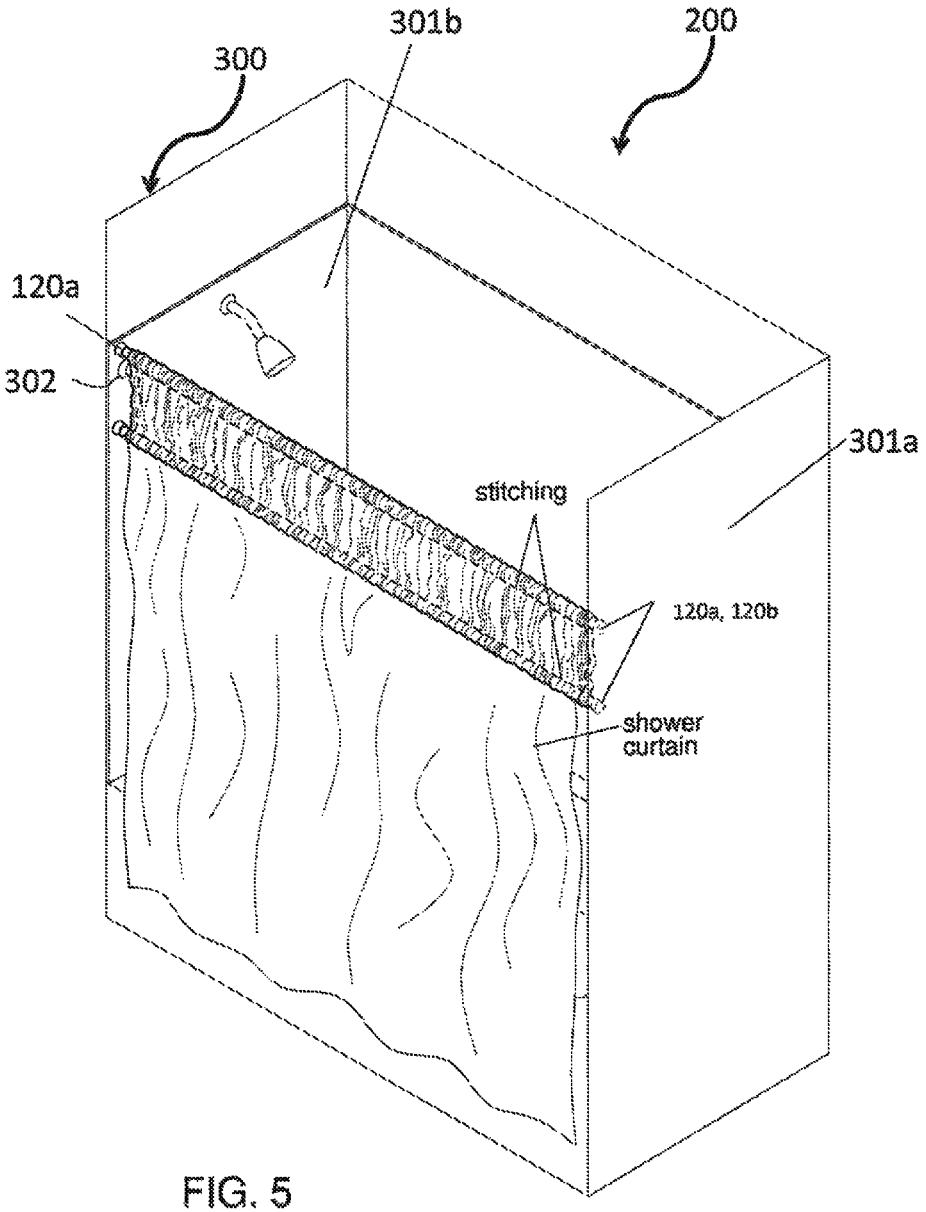
FIG. 5 is an in-use view of the system of the present invention.

For example, as shown in FIG. 5, the present invention features a bathroom system (200) comprising a shower compartment (300) having a first wall (301*a*) and an opposing second wall (301*b*). Such shower compartments are well known to one of ordinary skill in the art. The system (200) further comprises one or both of a shower or a bathtub disposed between the walls (301). A shower curtain rod (302) is sandwiched between the first wall (301*a*) and the second wall (301*b*) in a standard manner.

The concealing system (100) of the present invention helps to hide shower curtain rod (302) as shown in FIG. 5. As shown in FIG. 1-4, the concealing system (100) comprises a sheet (110) having a first end (111), a second end (112) opposite the first end (111), a third end (113), and a fourth end (114). The sheet (110) may be constructed from a variety of materials including but not limited to cotton, linen, satin, suede, wool, the like, or a combination thereof. The sheet (110) may be constructed in a variety of styles and designs as desired.

A first hollow channel (120*a*) is disposed along at least a portion of the first end (111) of the sheet (110), and a second hollow channel (120*b*) is disposed along at least a portion of the second end (112) of the sheet (110). The channels (120) run parallel to each other and are spaced a distance apart (e.g., between about 3 to 6 inches, between about 6 to 12 inches, at least 12 inches, etc.).

A first concealing rod (101*a*) is disposed in the first hollow channel (120*a*). The first concealing rod (101*a*) extends past the first end and the second end of the first hollow channel (120*a*). A second concealing rod (101*b*) is disposed in the second hollow channel (120*b*) and extends past the first end and the second end of the second hollow channel (120*b*). In some embodiments, the concealing rods (101) are extension rods.

In some embodiments, the first hollow channel (120*a*) and the second hollow channel (120*b*) both extend past both the third side edge (113) and the fourth side edge (114) of the sheet (110).

The concealing rods (101) are spaced a distance apart. In some embodiments, the distance is between about 3 to 6 inches. In some embodiments, the distance is between about 6 to 12 inches. In some embodiments, the distance is at least about 12 inches.

In some embodiments, gripping components are disposed on the outer ends of the concealing rods (101). Gripping components, e.g., rubber grippers, are well known to one of ordinary skill in the art. The gripping component is not limited to rubber.

As shown in FIG. 5, the concealing rods (101) are sandwiched between the walls (301) of the shower compartment (200) and are positioned such that the sheet (110) covers the shower curtain rod (302) and conceals it from view.

In some embodiments, a first line of stitching (130*a*) is disposed at an intersection of the first hollow channel (120*a*) and the first end (111) of the sheet (110). The first line of stitching (130*a*) may run the length of the first hollow channel (120*a*). In some embodiments, a second line of stitching (130*b*) is disposed at an intersection of the second hollow channel (120*b*) and the second end (112) of the sheet (110). The second line of stitching (130*b*) may run a length of the second hollow channel (120*b*). In some embodiments, a third line of stitching (130*c*) extends from the first hollow channel (120*a*) to the second hollow channel (120*b*) at or near the third side edge (113) of the sheet (110). In some embodiments, a fourth line of stitching (130*d*) extending from the first hollow channel (120*a*) to the second hollow channel (120*b*) at or near the fourth side edge (114) of the sheet. The lines of stitching (130) may help ensure that the sheet (110) maintains shape and security with respect to the hollow channels (120).

As used herein, the term "about" refers to plus or minus 10% of the referenced number.

The disclosures of the following U.S. Patents are incorporated in their entirety by reference herein: U.S. Pat. No. 3,083,494; U.S. Pat. No. 5,101,877; U.S. Pat. No. 5,154,218; U.S. Design Pat. No. D362,147; U.S. Pat. No. 7,909,082; U.S. Pat. Application No. 2006/0248641.

Various modifications of the invention, in addition to those described herein, will be apparent to those skilled in the art from the foregoing description. Such modifications are also intended to fall within the scope of the appended claims. Each reference cited in the present application is incorporated herein by reference in its entirety.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

The reference numbers recited in the below claims are solely for ease of examination of this patent application, and are exemplary, and are not intended in any way to limit the scope of the claims to the particular features having the corresponding reference numbers in the drawings.

What is claimed is:

1. A bathroom system (200) consisting of:

(a) a shower compartment (300) consisting of a first wall (301*a*) and an opposing second wall (301*b*), one or both of a shower or a bathtub disposed between the walls (301), and a shower curtain rod (302) sandwiched between the first wall (301*a*) and the second wall (301*b*);

(b) a concealing system (100) for hiding the shower curtain rod (302), said concealing system (100) consisting of: (i) a sheet (110) consisting of a first end (111), a second end (112) opposite the first end (111), a third end (113), and a fourth end (114); (ii) a first hollow channel (120*a*) disposed along at least a portion of the first end (111) of the sheet (110), and a second hollow channel (120*b*) disposed along at least a portion of the second end (112) of the sheet (110), the channels (120) run parallel to each other, wherein the first hollow channel (120*a*) and the second hollow channel (120*b*) both extend past both the third end (113) and the fourth end (114) of the sheet (110);

(c) a first concealing rod (101*a*) disposed in the first hollow channel (120*a*) and extending past a first end and a second end of the first hollow channel (120*a*), and a second concealing rod (101*b*) disposed in the second hollow channel (120*b*) and extending past a first end and a second end of the second hollow channel (120*b*);

(d) a first line of stitching (130*a*) disposed at an intersection of the first hollow channel (120*a*) and the first end (111) of the sheet (110), the first line of stitching (130*a*) runs a length of the first hollow channel (120*a*), and a second line of stitching (130*b*) disposed at an intersection of the second hollow channel (120*b*) and the second end (112) of the sheet (110), the second line of stitching (130*b*) runs a length of the second hollow channel (120*b*), the lines of stitching (130) help ensure that the sheet (110) maintains shape and security with respect to the hollow channels (120); and (e) a third line of stitching (130*c*) extending from the first hollow channel (120*a*) to the second hollow channel (120*b*) at or near the third side edge (113) of the sheet (110), and a fourth line of stitching (130*d*) extending from the first hollow channel (120*a*) to the second hollow channel (120*b*) at or near the fourth side edge (114) of the sheet (110);

wherein the concealing rods (101) are sandwiched between the walls (301) of the shower compartment (200) such that the sheet (110) covers the shower curtain rod (302) and conceals it from view, wherein gripping components are disposed on outer ends of the concealing rods (101), wherein the concealing rods (101) extend to the walls (301) such that the gripping components directly touch and grip the walls (301), and wherein the second concealing rod (101*b*) is positioned below the first concealing rod (101*a*) and above the bathtub such that the second concealing rod (101*b*) is between the first concealing rod (101*a*) and the bathtub, and wherein the first concealing rod (101*a*) and the second concealing rod (101*b*) are extension rods.

* * * * *